United States Patent [19]

Zbin

[11] Patent Number: 4,997,008

[45] Date of Patent: Mar. 5, 1991

[54] FAUCET SPOUT ASSEMBLY

[75] Inventor: Kurt J. Zbin, Lakewood, Ohio

[73] Assignee: Moen Incorporated, Elyria, Ohio

[21] Appl. No.: 514,978

[22] Filed: Apr. 26, 1990

[51] Int. Cl.[5] ..... E03C 1/02

[52] U.S. Cl. ..... 137/801; 137/615; 285/281

[58] Field of Search ..... 137/359, 615, 801; 285/281, 388

[56] References Cited

U.S. PATENT DOCUMENTS

| | | | |
|---|---|---|---|
| 2,438,529 | 3/1948 | Woodling | 285/281 |
| 4,037,624 | 7/1977 | Turner et al. | 137/615 |
| 4,346,735 | 8/1982 | Raz | 137/801 X |
| 4,456,287 | 6/1984 | Bisowaya | 137/615 X |
| 4,457,342 | 7/1984 | Moen | 137/615 X |
| 4,592,388 | 6/1986 | Wilcox | 137/615 X |

*Primary Examiner*—Gerald A. Michalsky

*Attorney, Agent, or Firm*—Kinzer, Plyer, Dorn, McEachran & Jambor

[57] ABSTRACT

A faucet spout assembly includes a tubular spout and a spout support nut. The spout has a discharge which is a substantial distance from the spout inlet. The spout support nut is used to mount the spout to a supporting waterway and provides both support for the spout to prevent wobble and a seal preventing undesirable moisture and other comtaminants from reaching the interior of the spout/support nut connection.

4 Claims, 2 Drawing Sheets

Fig. 2.
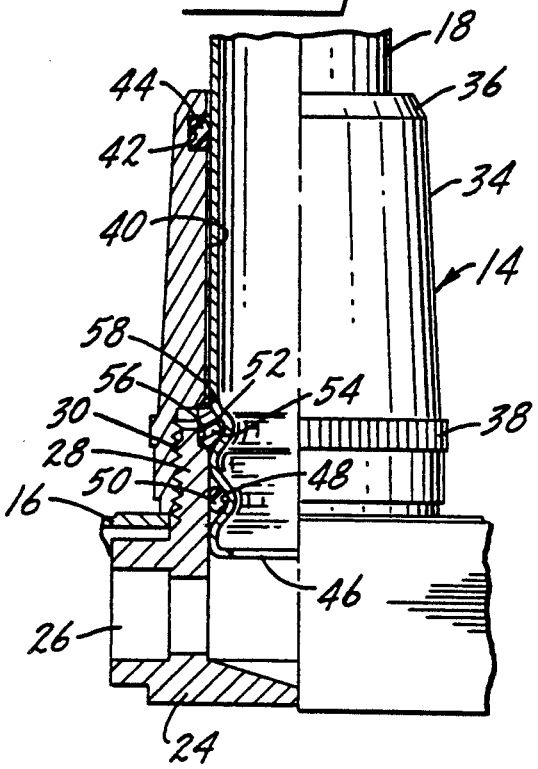
Fig. 3.
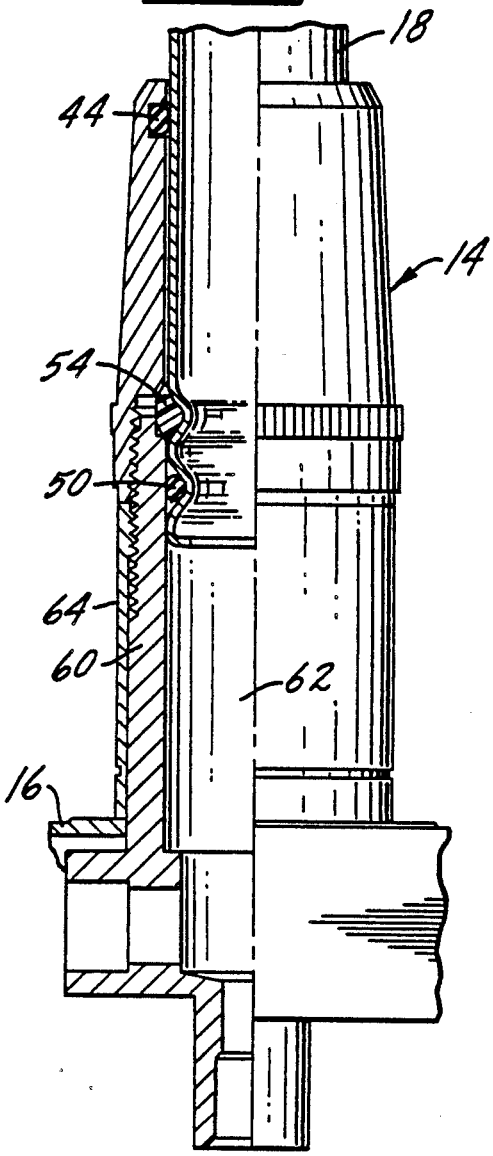
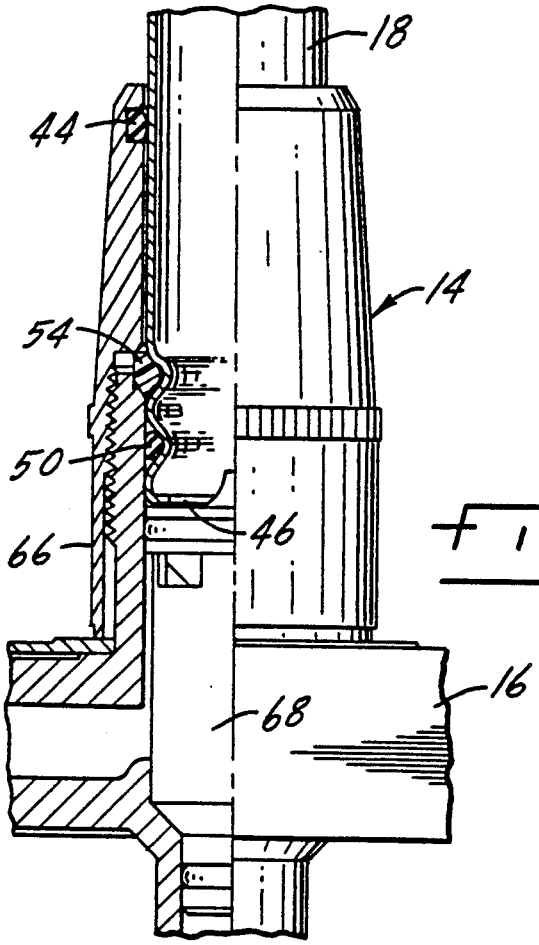
Fig. 4.

FAUCET SPOUT ASSEMBLY

SUMMARY OF THE INVENTION

The present invention relates to a high rise kitchen spout and in particular to a means for supporting the spout to prevent wobble and to provide a seal preventing contaminants from reaching the interior of the spout support connection.

A primary purpose of the invention is to provide a spout support nut which has an exterior decorative surface, has a substantial axial length, and at its upper end provides a sealing support for a freely movable high rise spout.

Another purpose is to provide a faucet spout assembly as described in which the support nut may have an axial extension, either integral or separate, to provide for a diverter to be positioned beneath the support nut and directly adjacent the spout inlet.

Another purpose is to provide a high rise kitchen faucet spout assembly in which the spout discharge is a substantial distance from the spout inlet, which assembly includes a support nut having an exterior decorative surface and a sealing support ring at the upper end thereof.

Other purposes will appear in the ensuing specification, drawings and claims.

BRIEF DESCRIPTION OF THE DRAWINGS

The invention is illustrated diagrammatically in the following drawings wherein:

FIG. 2 is an enlarged partial section illustrating the spout support nut and a portion of the spout, FIG. 3 is an axial section, similar to FIG. 2, but showing a modified form of spout support nut, and FIG. 4 is a section, similar to FIGS. 2 and 3, but showing a further modified form of spout support nut.

DESCRIPTION OF THE PREFERRED EMBODIMENT

Figure 1:
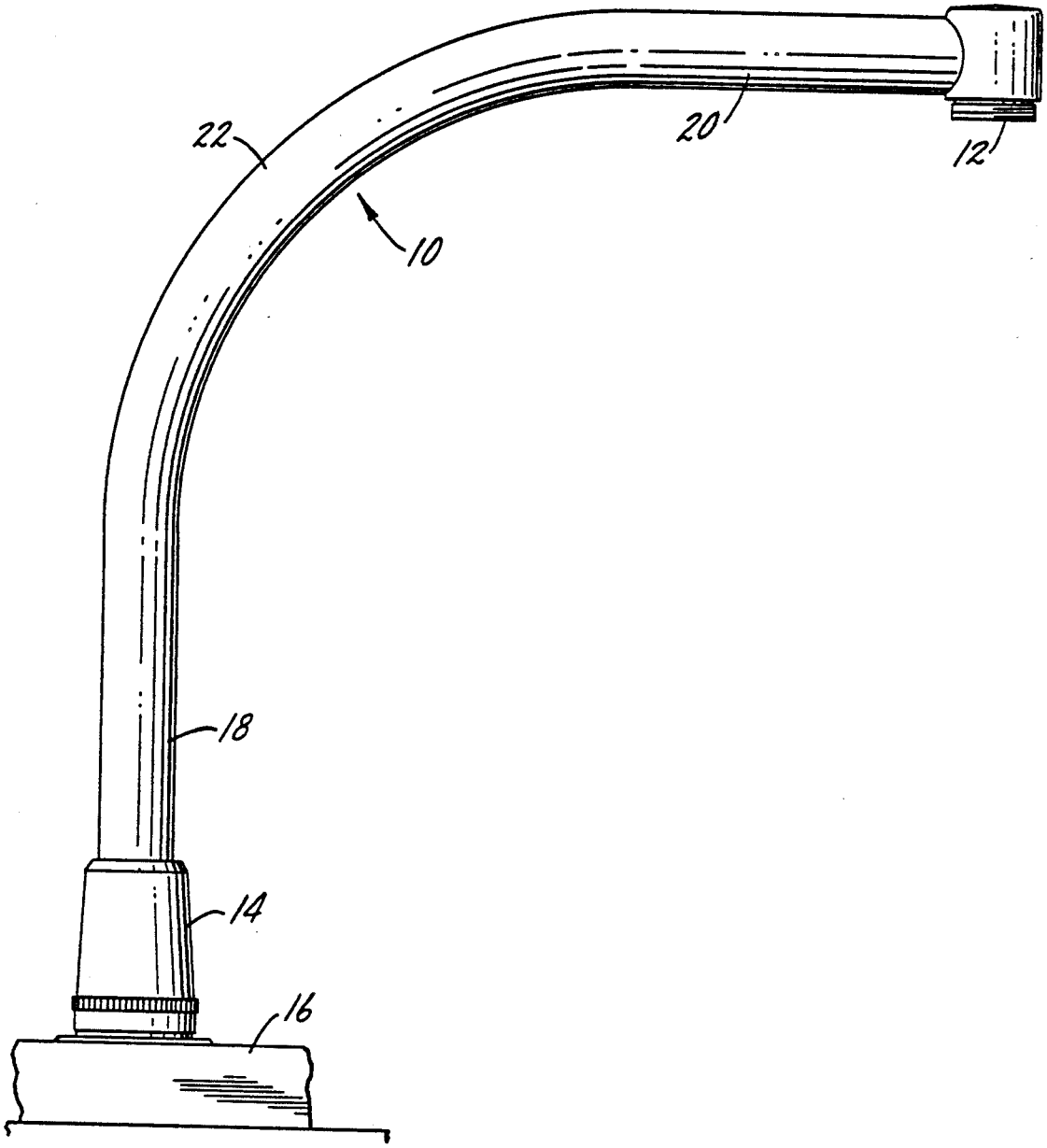
FIG. 1 is a side view of the faucet spout assembly of the present invention.

High rise spouts are one of the recent innovations in kitchen faucets. A high rise type of spout provides certain utilitarian advantages in that the discharge of the spout is a substantial distance above the bottom of the sink, thus providing the ability to wash utensils of substantial size in the sink. Further, such spouts can have an exterior which is esthetically pleasing and adds a design element to what is normally considered a utilitarian kitchen appliance. However, with such high rise spouts, the spout discharge is a substantial distance from the spout inlet and this provides stability problems, particularly for a spout that swivels as do most kitchen faucets. The present invention is particularly concerned with a high rise kitchen spout assembly and more particularly to a support nut which is decorative in appearance and provides a positive seal with the spout and a support for the inlet end of the spout to prevent wobble and other undesirable spout movements.

In FIG. 1, the high rise kitchen spout is shown to include a tubular spout 10 having a spout discharge 12 and a support nut 14 which mounts the spout on an escutcheon 16. Spout 10 may have a generally vertical tubular portion 18 and a generally horizontal portion 20 adjacent discharge 12, with the tubular portions 18 and 20 being joined by a gently curved intermediate portion 22.

Looking specifically at FIG. 2, positioned within the escutcheon 16 and above the sink top is a spout nipple 24 having conduits for hot and cold water, one of which is indicated at 26. Nipple 24 has a generally vertical tubular portion 28 which has an exterior thread 30 by means of which support nut 14 is attached to the nipple.

The support nut has an exterior decorative surface indicated at 34 which may have a gently tapered or conical configuration with an inwardly slanted upper end 36 and a grooved or knurled surface 38 adjacent the lower end. The interior of support nut 14 has a generally cylindrical surface 40 which has a diameter slightly greater than the outer diameter of tubular portion 18 of the spout. Thus, the spout is freely movable within the support nut and, as is conventional in kitchen faucets, the spout will pivot so as to be moved about the area of the sink.

Formed adjacent the upper end of support nut 14 interior surface 40 is a groove 42 within which is positioned a seal ring 44. The seal ring will bear against the exterior of the generally vertical tubular spout portion 18 and form a seal therewith. Thus, water and other contaminants such as cleaning material or the like will not be able to pass down between the support nut and the spout and corrode the lower end of the spout and support nut, which corrosion could ultimately inhibit or impair the ability of the spout to freely swivel within the support nut. Seal 44 not only provides the described sealing function, but also provides support to the spout at the highest vertical position of the support nut. As can be seen from FIG. 1, the discharge end of the spout is a substantial distance from the spout inlet 46. The spout can easily wobble if it is not adequately supported. Seal ring 44 provides support for the spout at a distance somewhat above the sink deck, as support nut 14 extends a substantial distance up the generally vertical portion of the spout.

The lower end of tubular portion 18, adjacent inlet 46, has an inwardly-directed annular groove 48 within which is positioned a seal ring 50, with the seal ring sealing against the tubular extension of the nipple, preventing any leakage from the bottom of the support nut. Adjacent groove 48 is a recess 52 within which is positioned a plastic retaining ring 54 which fits within the described spout recess and within adjoining recesses 56 and 58 formed on adjacent portions of the tubular extension 28 of the nipple and the interior of support nut 14. Retaining ring 54 is effective to prevent removal of the spout from the support nut as the retaining ring interlocks these elements together.

The spout assembly in FIGS. 1 and 2 provides a high rise kitchen spout in which the spout discharge is a substantial distance both vertically and horizontally from the spout inlet. The spout is attached to the underlying waterway by a retaining ring and there is a seal between these elements preventing leakage at that point. A spout support nut encircles the lower end of the spout and is threadedly engaged with a tubular extension of the waterway. The described retaining ring fits in cooperating adjoining grooves or recesses on the tubular extension of the waterway and the spout support nut. At the upper end of the spout support nut, as far from the spout inlet and the sink top as is possible considering the dimensions of these elements, there is a seal ring positioned within a groove in the support nut which provides both sealing and support for the spout.

The configuration in FIGS. 1 and 2 does not provide for a diverter assembly which is necessary if the kitchen faucet is to have an auxiliary spray. The configurations of FIGS. 3 and 4 raise the level of the spout support nut above that of the sink top so that a diverter may be positioned beneath the spout. In the configurations of FIGS. 3 and 4, like parts have been given the same numbers as in the earlier embodiment.

In FIG. 3, the tubular extension of the nipple, indicated at 60, has a substantially greater vertical height than the extension 28 in FIG. 2. This provides a space 62 beneath the spout inlet where a diverter assembly may be positioned. The space between the bottom of support nut 14 and escutcheon 16 is taken up by a support nut extension sleeve 64 which is also threaded onto the exterior of tubular extension 60. Sleeve 64 may have the same decorative exterior as support nut 14 and will provide the same esthetic desirable appearance, the only difference from the FIG. 2 embodiment being the fact that the support nut is raised above the level of the sink.

The FIG. 4 embodiment is similar to that of FIG. 3, except in this instance the extension of support nut 14 is integral with the support nut. The tubular extension 66 is an integral extension of the lower cylindrical portion of the support nut and has essentially the same outer diameter as the lower end of the support nut. In FIG. 4, a diverter assembly 68 is positioned within the spout nipple 24 and directly beneath the inlet 46 of the spout.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet spout assembly including a tubular spout which has an inlet and a discharge, said tubular spout having a generally vertical portion extending upwardly from said inlet, a curved portion and a spout discharge located a substantial vertical and horizontal distance from said spout inlet, a spout nipple having a generally vertical tubular portion with an exterior thread, an exteriorly decorative spout support nut extending about the generally vertical portion of said spout, said nut extending over a substantial portion of said spout generally vertical portion, said nut having an interior threaded portion cooperating with said spout nipple to mount the spout thereon, said nut having an interior surface with a diameter slightly larger than the O.D. of said spout vertical portion to permit free movement of said spout relative to said nut, a groove in the interior surface of said nut closely adjacent the upper end thereof, a seal ring positioned in said groove and bearing against the exterior of said spout generally vertical portion to provide a seal between said nut interior surface and the spout outer surface to prevent moisture and other contaminating material from reaching the space between said nut and tubular spout, said seal ring further providing a support for said spout, preventing unwanted wobbling movement thereof, the interior of said support nut and the interior of said spout nipple vertical tubular portion having adjoining recesses, a retaining ring positioned in said support nut and spout nipple vertical portion tubular recesses, an annular recess in said spout generally vertical portion opposite the recesses in said support nut and tubular portion, said retaining ring extending into said spout recess, said retaining ring interlocking said spout generally vertical portion with said support nut and the vertical tubular portion of the spout nipple, the exterior of said spout generally vertical portion adjacent the inlet and spaced from said retaining ring recess having an annular groove, a seal ring positioned therein, with the exterior of said seal ring being in sealing contact with said spout nipple vertical tubular portion.

2. The faucet spout assembly of claim 1 further characterized in that the exterior of said nut has a slightly tapered conical portion, the smallest diameter of which is at the upper end thereof.

3. The faucet spout assembly of claim 2 further characterized in that said support nut includes a generally cylindrical portion adjacent the lower end of said conical portion and integral therewith.

4. The faucet spout assembly of claim 2 further characterized in that said support nut includes a generally cylindrical portion having an outer diameter approximately the same as the larger diameter of said conical portion and positioned beneath said conical portion, said cylindrical portion being a separate element, separately threaded to said spout nipple vertical tubular portion.

* * * * *